US007019242B2

(12) United States Patent
Kim

(10) Patent No.: US 7,019,242 B2
(45) Date of Patent: Mar. 28, 2006

(54) ELECTROLUMINESCENT METAL DOME KEYPAD

(75) Inventor: Eun Soo Kim, Masan (KR)

(73) Assignee: KBF Co., Ltd, Gyeongsangnam-Do (KR)

( * ) Notice: Subject to any disclaimer, the term of this patent is extended or adjusted under 35 U.S.C. 154(b) by 0 days.

(21) Appl. No.: 10/962,780

(22) Filed: Oct. 12, 2004

(65) Prior Publication Data

US 2005/0241927 A1 Nov. 3, 2005

(30) Foreign Application Priority Data

May 1, 2004 (KR) ..... 20-2004-0012269

(51) Int. Cl.
*H01H 13/02* (2006.01)

(52) U.S. Cl. ..... 200/514; 200/5 A; 200/314

(58) Field of Classification Search ..... 200/510–517, 200/5 A, 5 R, 310–317; 362/23, 29, 84
See application file for complete search history.

(56) References Cited

U.S. PATENT DOCUMENTS 4,060,653 A * 11/1977 Everett, Jr. ..... 200/5 A
5,871,088 A * 2/1999 Tanabe ..... 200/514
6,595,653 B1 * 7/2003 Saito et al. ..... 200/513

FOREIGN PATENT DOCUMENTS

JP 2004079338 A * 3/2004

* cited by examiner

*Primary Examiner*—Lincoln Donovan
*Assistant Examiner*—M. Fishman
(74) *Attorney, Agent, or Firm*—Law Offices of Royal W. Craig

(57) ABSTRACT

The present invention relates to an EL metal dome keypad which comprises a plurality of domes which are disposed at positions corresponding to fixed contact terminals of a printed circuit board and are brought into contact with or separated from the fixed contact terminals by means of elastic deformation; a base tape which is laminated on the printed circuit board, has a plurality of holes formed at positions corresponding to the domes, and is used to mount the domes to the printed circuit board by inserting and holding the domes into the formed holes; double-sided adhesive tape which is laminated in the base tape and the domes inserted into and held to the holes formed in the base tape, and used to attach and hold the base tape and the dome thereon; and an EL sheet which is attached and laminated on the double-sided adhesive tape.

9 Claims, 7 Drawing Sheets

ELECTROLUMINESCENT METAL DOME KEYPAD

BACKGROUND OF THE INVENTION

This application claims the priority of Korean Utility Model Application No. 2004-12269 filed on May 1, 2004, in the Korean Intellectual Property Office, the disclosure of which is incorporated herein in its entirety by reference.

1. Field of Invention

The present invention relates to a keypad as a switch device for generating a signal in communication equipment, and more particularly, to an electroluminescent (EL) metal dome keypad configured in such a manner that an EL element is used as a light-emitting source and backlighting and switching functions are both included.

2. Description of the Prior Art

Generally, a keypad is a switch device for generating a signal, which is used for an electronic communication equipment such as a mobile phone or a remote control. The keypad has a separate light-emitting function that allows numeral- or character-printed keys to be identified and used at night or in dark places. The types of keypads having a light-emitting function will be discussed along evolved processes. Examples of such keypads include a LED type keypad, an EL sheet embedded keypad, an EL dome tape type keypad, an EL metal dome integrated keypad, and the like.

FIG. 1 is a sectional view of an LED type keypad. If any of protrusions 121 of the key top 120 are pressed, a relevant dome 150 is deformed and contacts with a fixed contact terminal 171 in a printed circuit board 170. Such a switching operation enables a power supply voltage from the printed circuit board 170 to be applied to a light emitting diode (LED) 160. The LED emits light and illuminates the key top 120.

However, in this LED type keypad, light emitted from the LED 160 is not uniformly delivered to the key top 120 positioned over the LED 160. It causes a problem that the visibility of numerals, characters, etc. printed on the keys, which outwardly protrude from the front case 110, is deteriorated and the uniformity of illumination is degraded. A use of a number of LEDs 160 can solve this problem, but it causes another problem of increased product cost and needs separate space for mounting the LEDs 160.

FIG. 2 is a sectional view of the EL sheet-embedded keypad disclosed in Korean Patent No. 10-384993, in which an EL is used as an emitting source and an EL sheet 230 is inserted into a key top 220. With this EL sheet-embedded keypad, the problem associated with the above LED type keypad may be solved. However, there is a need for an additional working process of inserting the EL sheet 230 into the key top 220. In addition, there arises a problem in that such a complex structure of the key top 220 increases failure rates and increases production costs.

FIG. 3 is a sectional view of the EL dome tape keypad disclosed in Korean Utility Model Registration No. 20-325934. An EL is used as a light-emitting source. An EL sheet 340 is laminated on a printed circuit board 360, and a top tape 330 is laminated on the EL sheet 340 to protect the EL sheet 340. With the EL dome tape keypad, the problem associated with the aforementioned EL sheet-embedded keypad can be solved by simplifying the working process and reducing reflective proportion.

However, there are problems in that stability of the EL dome sheet type keypad is reduced due to a unique noise generated in the EL sheet 340 itself and the switching function of domes 350 cannot be smoothly performed due to difficulty in managing deviations resulting from the top tape 330 with a thickness of about 75 μm and the EL sheet 340 with a thickness of about 200 μm.

In other words, electrical noise generated in the EL sheet 340, vibrations due to trembling of the sheet itself, or the like have influence on the domes 350, and thicknesses of the top tape 330 and the EL sheet 340 increase the operation load for bringing the domes 350 into contact with fixed contact terminals 361 of the printed circuit board 360, thus leading to poor click sense. Further, an irradiation function, electro static discharge (ESD), or the like may cause a serious problem in product performance.

FIG. 4 is a sectional view of an EL metal dome integrated keypad applied with a switch, which is disclosed in Japanese Patent Laid-Open Publication No. 2004-79338. An EL is used as a light-emitting source. A base tape 440 for holding domes 460 is laminated on a printed circuit board 470, and an EL sheet 430 is laminated on the base tape 440. At this time, the EL sheet 430 and the base tape 440 are attached to each other by double-sided adhesive tape 450, which has holes larger than the diameter of the domes 460. In this EL metal dome integrated keypad, the stability of products can be increased by minimizing influence from unique noise generated in the EL sheet 430 itself, and the switching operation load can be reduced and the click sense can be improved by relatively reducing the thickness between protrusions 421 of the key top 420 and the domes 460, thereby solving the problem associated with the aforementioned EL dome tape keypad.

Meanwhile, the working process of the aforementioned EL metal dome integrated keypad will be discussed. The top surface of the base tape 440 is attached to one side of the double-sided adhesive tape 450, and the EL sheet 430 is attached to the other side of the double-sided adhesive tape 450. Subsequently, the domes 460 are attached from the bottom face of the base tape 440, and the base tape 440 is then attached to the printed circuit board 470. However, the following problem may arise in the working process. In other words, the position of the base tape 440 where the domes 460 will be attached cannot be exactly recognized, whereby it would yield numerous difficulties in the working process and cause potential defects. Further, since there is no additional means capable of holding the attached domes 460, it is likely that the dome 460 will deviate during the working process. In this EL metal dome integrated keypad, outer surfaces of the domes 460 and fixed contact terminals 471 of the printed circuit board 470 are stained with the adhesive coated on the bottom surface of the base tape 440, and the adhesive is then increasingly soaked into the dome 460. Therefore, this may cause inferior contact between the domes 460 and the fixed contact terminals 471.

SUMMARY OF THE INVENTION

Accordingly, the present invention is conceived to solve the aforementioned problems. It is an object of the present invention to provide an EL metal dome keypad capable of improving click sense by reducing switching operation load in which an EL is used as a light-emitting source, as well as of operating in a stable manner by minimizing defects through an enhanced working process.

According to the present invention for achieving the aforementioned object, the EL metal dome keypad comprises a printed circuit board which has a plurality of fixed contact terminals; a plurality of domes which are disposed at positions corresponding to the fixed contact terminals of the printed circuit board and are brought into contact with or separated from the fixed contact terminals by means of elastic deformation; a base tape which is laminated on the printed circuit board, has a plurality of holes formed at positions corresponding to the domes, and is used to mount the domes to the printed circuit board by inserting and holding the domes into the formed holes; double-sided adhesive tape which is laminated in the base tape and the domes inserted into and held to the holes formed in the base tape, and used to attach and hold the base tape and the dome thereon; an EL sheet which is attached and laminated on the double-sided adhesive tape and emits light by itself when a power supply voltage is applied; a key top which is disposed on the EL sheet and has protrusions for pressing the domes at positions corresponding to the domes; and a front case which is disposed on the key top.

At this time, the EL sheet may comprise a rear protective sheet, a luminous electrode layer, a dielectric layer, a luminous layer, a transparent electrode layer, a color filter layer, and a front protective sheet, which are sequentially laminated one above another. Further, in order to minimize inherently generated noise, the EL sheet further may comprise a rear electrode layer and an insulation layer that are laminated between the rear protective sheet and the luminous electrode layer.

Preferably, the keypad is configured in such a manner that an electromagnetic interference blocking printed layer can be further laminated on the base tape and the domes inserted into and held to the holes formed in the base tape. Further, a top tape for use in protecting a printed layer may be laminated beneath the electromagnetic interference blocking printed layer.

Furthermore, the EL sheet may be connected to the printed circuit board through at least one of power connection means including a conductive double-sided adhesive tape, a FPC and a wire, it is preferred that a printed layer for blocking electromagnetic interference be further laminated on the EL sheet.

DETAILED DESCRIPTION OF THE INVENTION

Hereinafter, the present invention will be described in detail with reference to the accompanying drawings.

Figure 1:
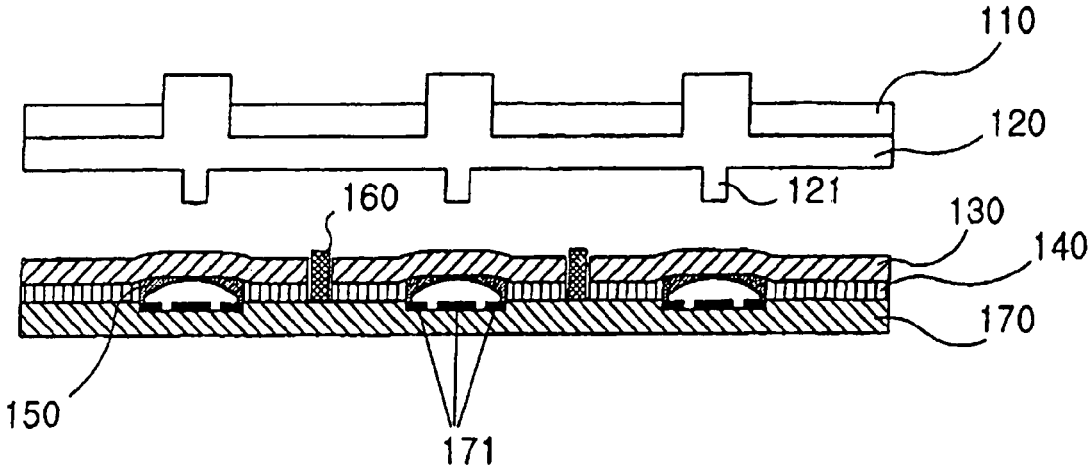
FIG. 1 (Prior Art)
FIG. 1 (Prior Art) is a sectional view of an LED type keypad.
Figure 2:
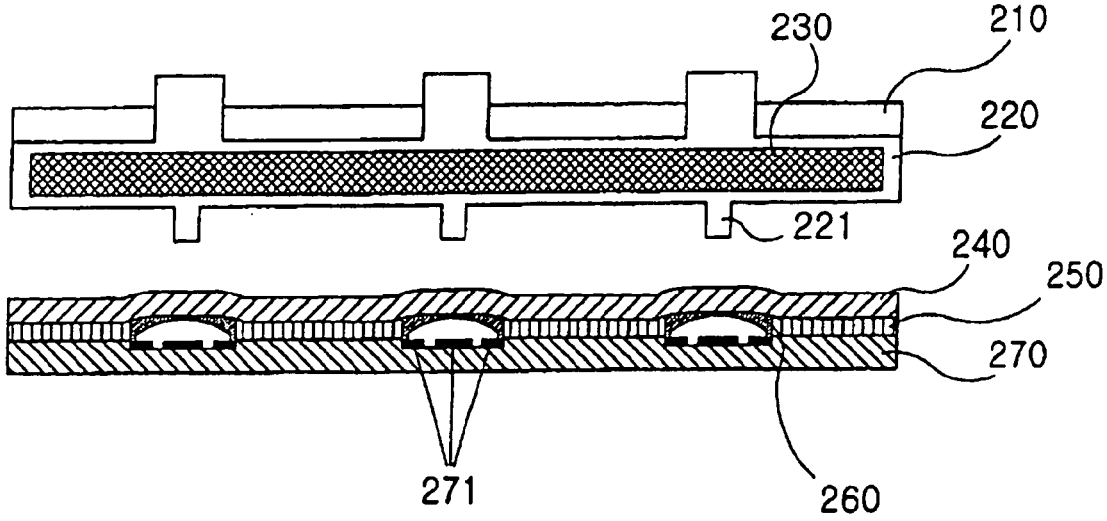
FIG. 2 (Prior Art)
FIG. 2 (Prior Art) is a sectional view of the EL sheet-embedded keypad.
Figure 3:
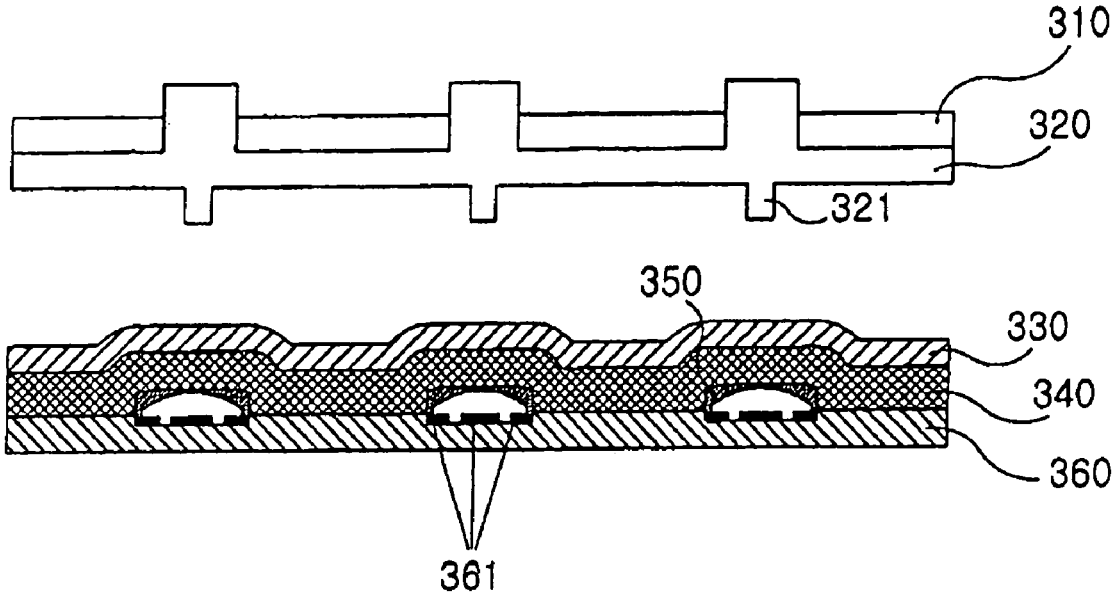
FIG. 3 (Prior Art)
FIG. 3 (Prior Art) is a sectional view of the EL dome tape keypad.
Figure 4:
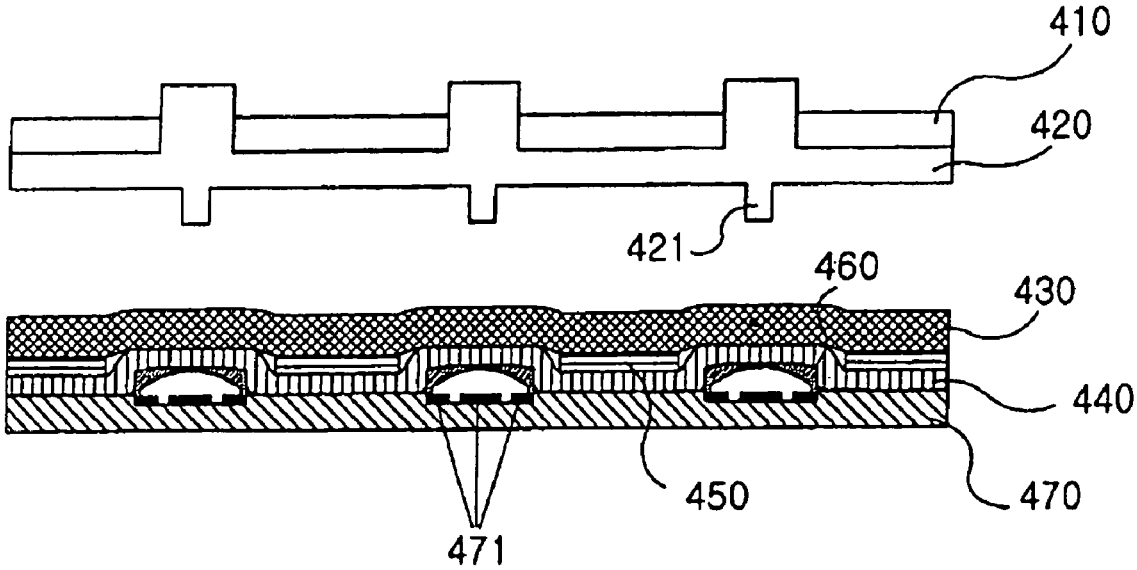
FIG. 4 (Prior Art)
FIG. 4 (Prior Art) is a sectional view of an EL metal dome integrated keypad.
Figure 5:
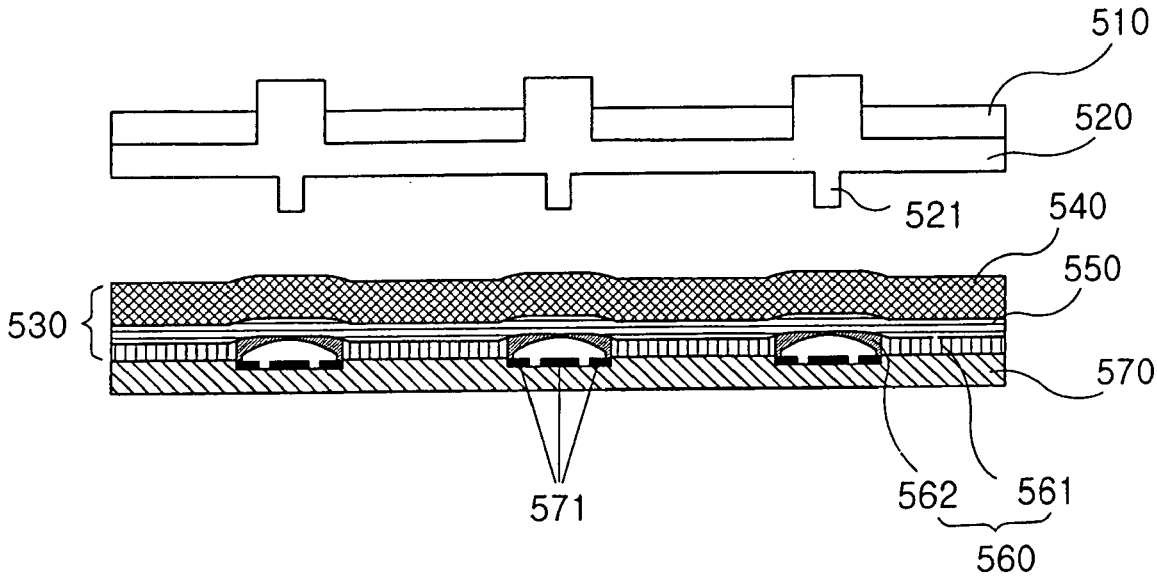
FIG. 5 is a sectional view of an EL metal dome keypad according to the present invention.
Figure 6:
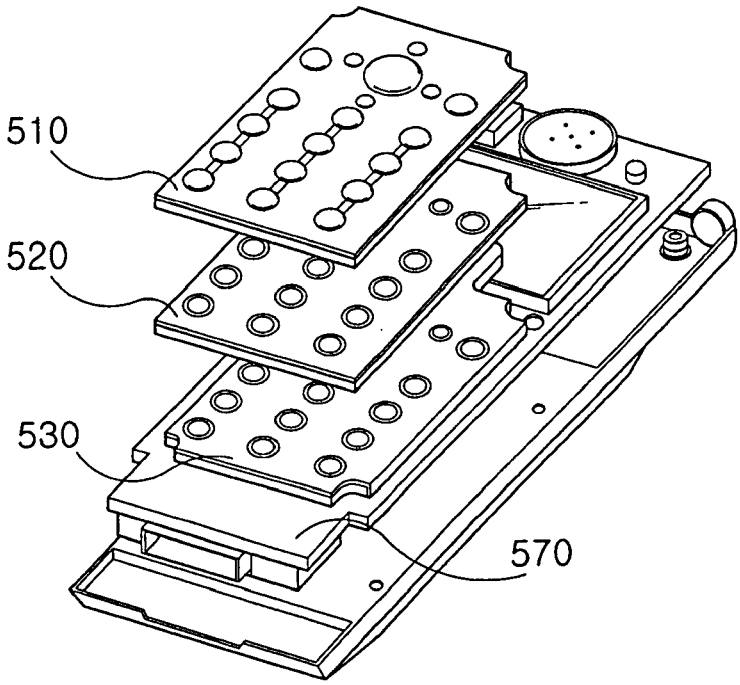
FIG. 6 is an exploded perspective view showing a state where the EL metal dome keypad is assembled into electronic communication equipment according to the present invention.

FIG. 5 is a sectional view of an EL metal dome keypad according to the present invention, and FIG. 6 is an exploded perspective view of an electronic communication equipment with which the keypad is engaged. In these figures, reference numeral "510" denotes a front case, reference numeral "520" denotes a key top, reference numeral "530" denotes an EL metal dome sheet, and reference numeral "570" denotes a printed circuit board. Reference numeral "521" denotes protrusions and reference numeral "571" denotes fixed contact terminals.

Referring to FIGS. 5 and 6, the EL metal dome sheet 530 is laminated on the printed circuit board 570, the key top 520 is disposed on the EL metal dome sheet 530, and the front case 510 is disposed on the key top 520. The EL metal dome sheet 530, which is an essential element of the present invention, is composed of a metal dome sheet 560 that performs a switching function, an EL sheet 540 that performs a rear emitting function, and double-sided adhesive tape 550 for causing the metal dome sheet 560 and the EL sheet 540 to be attached to each other. The metal dome sheet 560 is composed of domes 562, and a base tape 561 for holding the domes 562 and then mounting them to the printed circuit board 570.

Figure 7:
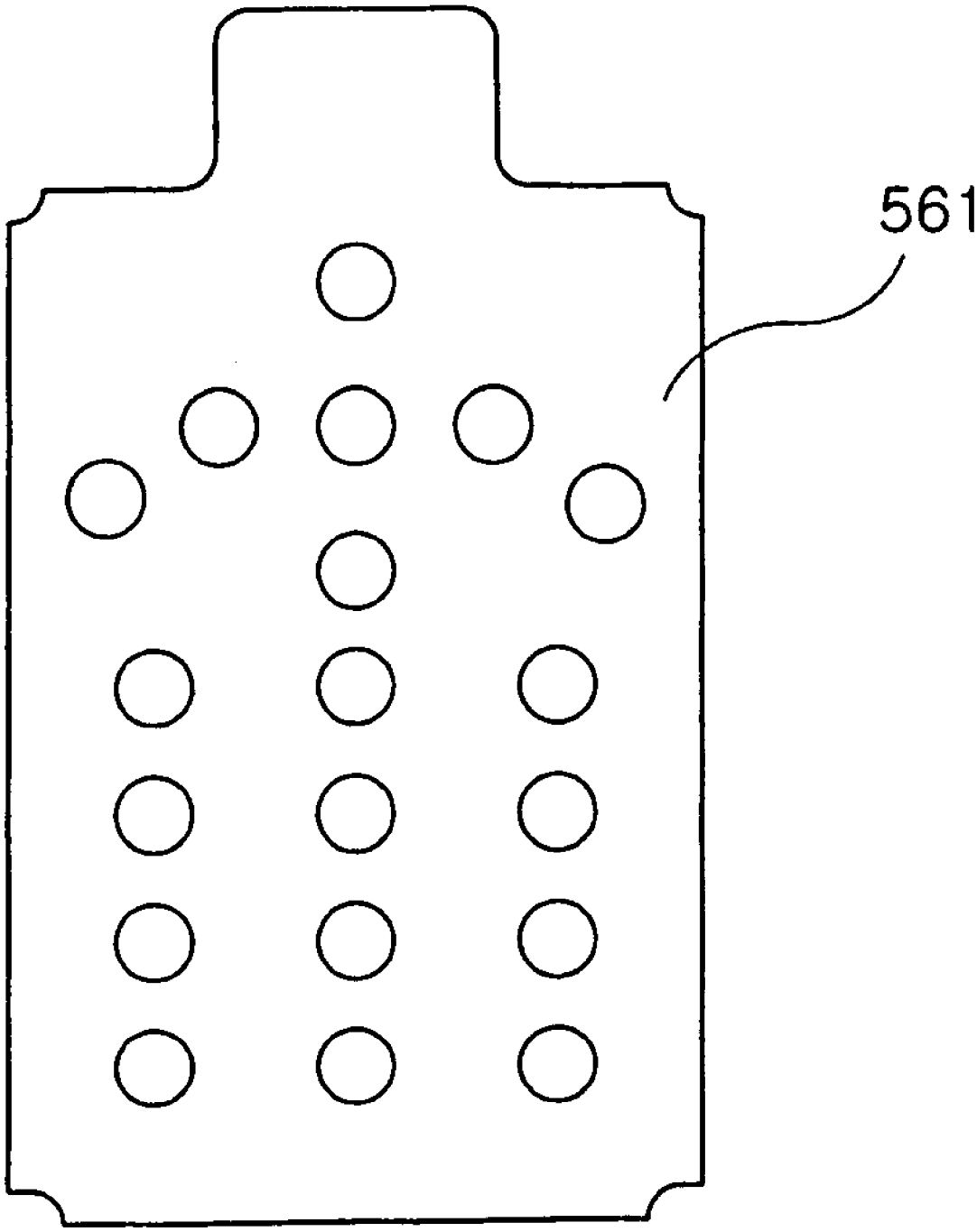
FIG. 7 is a plan view of a base tape according to the present invention.

The connection structure of the EL metal dome sheet 530 according to the present invention will be hereinafter described with reference to FIG. 5. First, the domes 562 are disposed at positions corresponding to the fixed contact terminals 571 of the printed circuit board 570. When pressed, the protrusions 521 of the key top 520 come into contact with the fixed contact terminals 571 or are separated from the fixed contact terminals 571 by elastic deformation. The base tape 561 is laminated on the printed circuit board 570. As shown in FIG. 7, a plurality of holes are formed at positions corresponding to the domes 562 in the base tape 561 in which the domes 562 are inserted into and held to the holes so that the base tape 561 is mounted to the printed circuit board 570. The double-sided adhesive tape 550 is laminated on the base tape 561 and the dome 562 inserted into and held to the holes formed in the base tape 561, thus attaching and holding the base tape 561 and the domes 562. At this time, the double-sided adhesive tape 550 serves as a buffer between the EL sheet 540 and the domes 562 when the protrusions 521 of the key top 520 are pressed.

The EL sheet 540 is attached and laminated to the double-sided adhesive tape 550. If a switching operation of the domes 562 enables a power supply voltage from the printed circuit board 570 to be applied, the EL sheet 540 emits light by itself and illuminates the key top 520 positioned on the EL sheet 540. As described above, in the EL metal dome keypad according to the present invention, only the EL sheet 540 and the double-sided adhesive tape 550 are laminated between the protrusion 521 of the key top 520 and the domes 562. This reduces the thickness that affects the operation load in the switching operation, resulting in improved click sense.

Meanwhile, the working process of the EL metal dome keypad according to the present invention will be discussed. First, the top surface of the base tape 561 having the holes formed therein is attached on one side of the double-sided adhesive tape 550, and then the EL sheet 540 is attached to the other surface of the double-sided adhesive tape 550. After the domes 562 are inserted and held into the holes of the base tape 561 and then attached to the double-sided adhesive tape 550, the base tape 561 is attached to the printed circuit board 570. Thus, the domes 562 are inserted into, held and attached to the holes formed in the base tape 561, which allows the positions at which the domes 562 are attached to be set exactly. It can enhance the working process and prevent the attached domes 562 from deviating, thereby reducing defects.

Figure 8A:
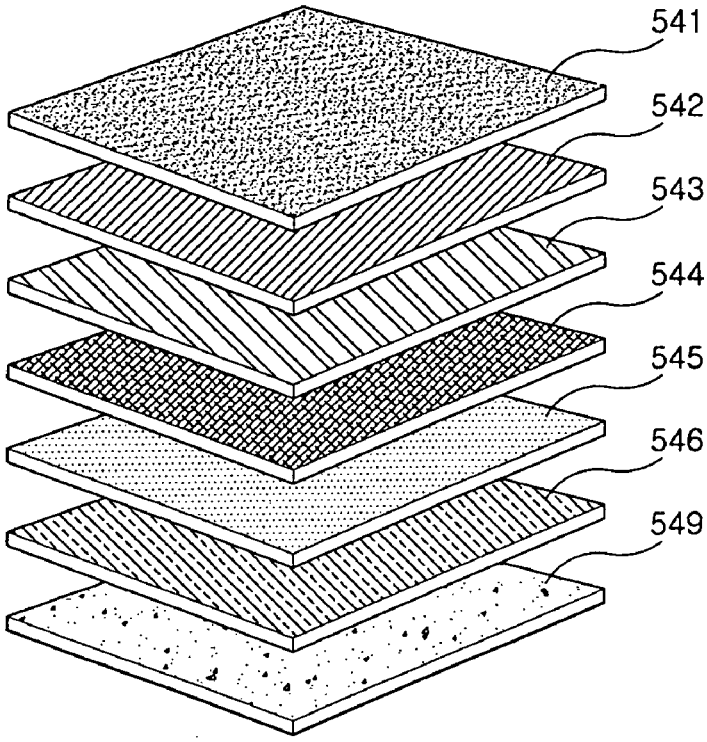
FIG. 8*a* is an exploded perspective view of a 2P-structured EL sheet applied to the EL metal dome keypad according to the present invention.

FIG. 8*a* is an exploded perspective view of a 2P-structured EL sheet applied to an EL metal dome keypad according to the present invention. The EL sheet comprises a rear protective sheet 549, a luminous electrode layer 546, a dielectric layer 545, a luminous layer 544, a transparent electrode layer 543, a color filter layer 542 and, a front protective sheet 541, which are sequentially laminated one above another.

If electric power is applied from the printed circuit board 570 to the EL sheet so configured, the luminous layer 544 will effect uniform surface light emission. Since the 2P-structured EL sheet is a well known technique, a detailed description thereof will be omitted herein.

Figure 8B:
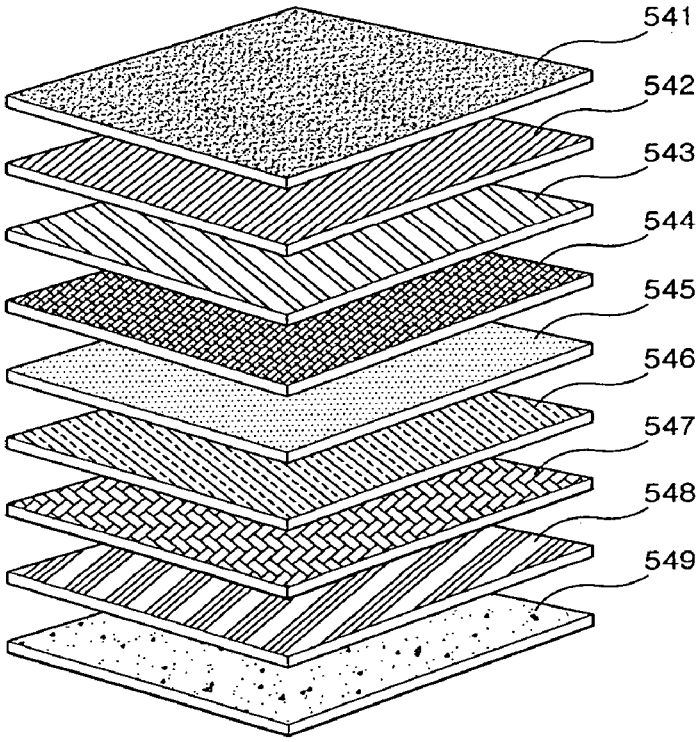
FIG. 8*b* is an exploded perspective view of a 3P-structured EL sheet applied to the EL metal dome keypad according to the present invention.

FIG. 8*b* is an exploded perspective view of a 3P-structured EL sheet applied to an EL metal dome keypad according to the present invention. The EL sheet further comprises a rear electrode layer 548 and an insulation layer 547, both of which are laminated between the rear protective sheet 549 and the luminous electrode layer 546 of the 2P-structured EL sheet shown in FIG. 8*a*.

This 3P-structured EL sheet can improve the noise phenomenon such as jitter that may be produced in the 2P-structured EL sheet. That is, noise which may be produced by attraction or repulsion due to charge differences between the luminous electrode layer 546 and the transparent electrode layer 543 can be minimized by means of inclusion of the rear electrode layer 548 and insulation layer 547.

Figure 9A:
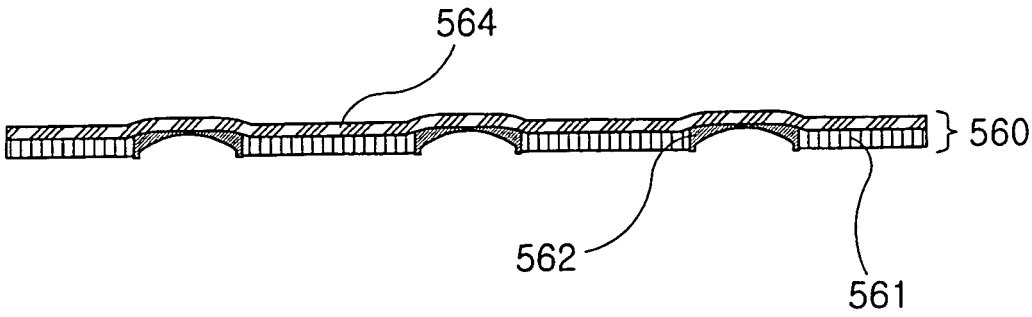
FIG. 9*a* is a sectional view of the metal dome sheet on which an electromagnetic wave blocking printed layer is further laminated according to the present invention.

FIG. 9*a* is a sectional view of the metal dome sheet on which an electromagnetic wave blocking printed layer is further laminated according to the present invention. It shows that a printed layer 564 for blocking electro magnetic interference (EMI) is further laminated on the base tape 561 and the domes 562 inserted into and held to the holes formed in the base tape 561. If the metal dome sheet 560 so configured is applied, EMI can be essentially blocked, whereby an EL metal dome keypad capable of operating more stably can be implemented.

Figure 9B:
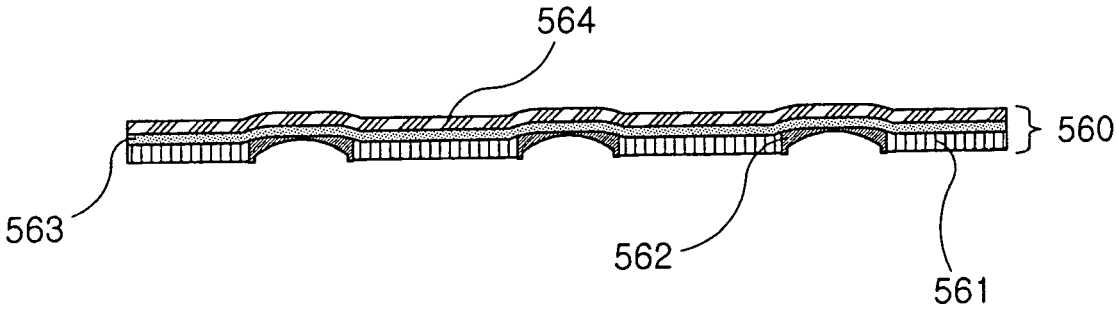
FIG. 9*b* is a sectional view of the metal dome sheet in which a top tape for use in protecting the printed layer is further laminated on the structure of the metal dome sheet as shown in FIG. 9*a* according to the present invention.

FIG. 9*b* is a sectional view of the metal dome sheet in which a top tape for use in protecting the printed layer is further laminated on the structure of the metal dome sheet as shown in FIG. 9*a* according to the present invention. These figures also show that the top tape 563 is further laminated beneath the electromagnetic interference blocking printed layer 564. If the metal dome sheet 560 so configured is applied, the printed layer 564 for blocking EMI can be protected, whereby an EL metal dome keypad capable of operating more stably can be implemented.

Figure 10:
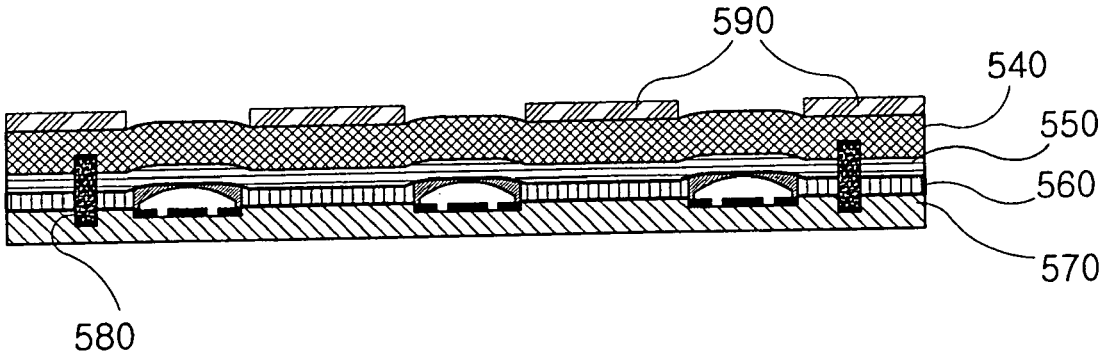
FIG. 10 is a sectional view showing a state where an EL sheet and a printed circuit board are interconnected with each other according to the present invention.

FIG. 10 is a sectional view showing a state where the EL sheet and printed circuit board are interconnected with each other according to the present invention. This figure shows a state where the EL sheet 540 is connected to the printed circuit board 570 through an additional connection means 580 capable of applying electric power. Here, a conductive double-sided adhesive tape, a flexible printed circuit (FPC), a wire or the like may be used as the connection means 580.

Furthermore, it is preferable to minimize effects of emission functions or ESD by further attaching a printed layer 590 for blocking EMI to the front surface of the EL sheet 540 where the connection means 580 are positioned, as shown in FIG. 10.

Figure 11:
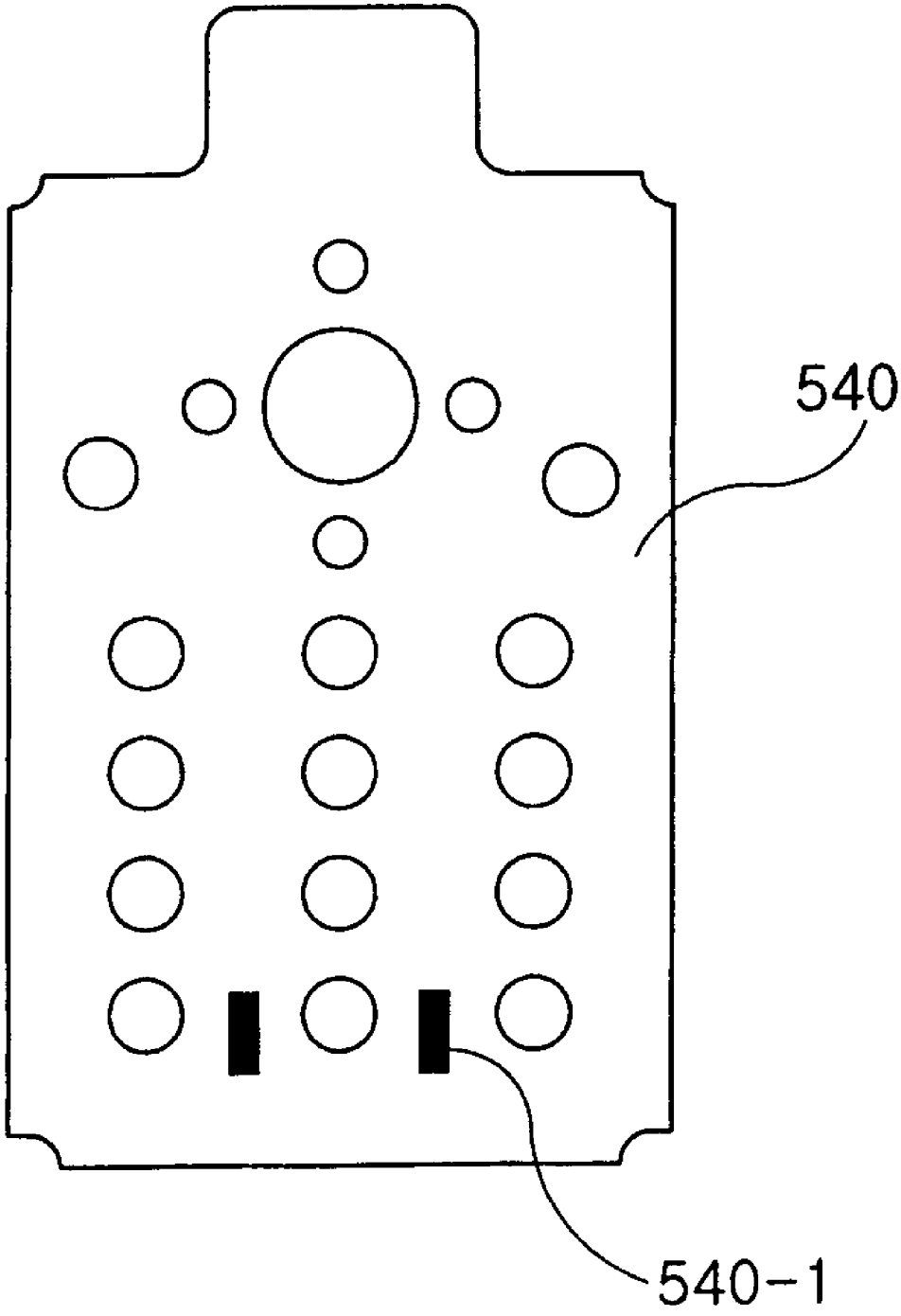
FIG. 11 is a rear view of the EL sheet with internal terminals integrated therein according to the present invention.

FIG. 11 is a rear view of the EL sheet with internal terminals integrated therein according to the present invention, and shows a state where connection terminals 540-1 are formed by coating output terminals, grounds and multi-function terminals of a rear portion in the EL sheet 540 with an adhesive made of a conductive component such as silver. Therefore, convenient and easy connection can be realized by directly attaching the conductive double-sided adhesive tape to the connection terminals 540-1 without using an additional connector.

According to the present invention, the EL metal dome keypad has the following advantages.

First, it is possible to enhance product stability by minimizing effects from unique noises, acoustic noises, vibrations, or the like generated by the EL itself. Second, it is possible to improve click sense by enhancing deviation management of the switch and reducing operation load of the switch. Third, it is possible to enhance product stability by enhancing the working process and minimizing defects. Fourth, it is possible to enhance product stability by minimizing effects from radiation functions and electro static discharges.

What is claimed is:

1. An electroluminescent (EL) metal dome keypad comprising:

a printed circuit board having a plurality of fixed contact terminals;

a plurality of domes disposed at positions corresponding to the fixed contact terminals of the printed circuit board, and brought into contact with or separated from the fixed contact terminals by means of elastic deformation;

a base tape laminated on the printed circuit board and having a plurality of holes formed at positions corresponding to the domes, said base tape being used to mount the domes to the printed circuit board by inserting and holding the domes into the formed holes;

double-sided adhesive tape laminated on the base tape and the domes, which are inserted into and held to the holes formed in the base tape, said double-sided adhesive tape being used to attach and hold the base tape and the dome thereon;

an EL sheet attached and laminated on the double-sided adhesive tape and emitting light by itself when a power supply voltage is applied, said EL sheet further comprising a rear protective sheet, a rear electrode layer, an insulation layer, a luminous electrode layer, a dielectric layer, a luminous layer, a transparent electrode layer, a color filter layer, and a front protective sheet all sequentially laminated together;

a key top disposed on the EL sheet and having protrusions for pressing the domes at positions corresponding to the domes; and a front case disposed on the key top.

2. The keypad as claimed in claim 1, wherein the keypad is configured in such a manner that an electromagnetic interference blocking printed layer is further laminated on the base tape and the domes inserted into and held to the holes formed into the base tape.

3. The keypad as claimed in claim 2, wherein the keypad is configured in such a manner that a top tape for use in protecting a printed layer is further laminated beneath the electromagnetic interference blocking printed layer.

4. The keypad as claimed in claim 1, wherein the EL sheet is connected to the printed circuit board through at least one of power connection means including a conductive double-sided adhesive tape, a FPC and a wire, and a printed layer for blocking electromagnetic interference is further laminated on the EL sheet.

5. The keypad as claimed in claim 4, wherein the conductive double-sided tape is attached and connected to portions subjected to the conductive silver circuit processing in output terminals, grounds, and multi-function terminals in the EL sheet.

6. The keypad as claimed in claim 2, wherein the EL sheet is connected to the printed circuit board through at least one of power connection means including a conductive double-sided adhesive tape, a FPC and a wire, and a printed layer for blocking electromagnetic interference is further laminated on the EL sheet.

7. The keypad as claimed in claim 3, wherein the EL sheet is connected to the printed circuit board through at least one of power connection means including a conductive double-sided adhesive tape, a FPC and a wire, and a printed layer for blocking electromagnetic interference is further laminated on the EL sheet.

8. The keypad as claimed in claim 6, wherein the conductive double-sided tape is attached and connected to portions subjected to the conductive silver circuit processing in output terminals, grounds, and multi-function terminals in the EL sheet.

9. The keypad as claimed in claim 7, wherein the conductive double-sided tape is attached and connected to portions subjected to the conductive silver circuit processing in output terminals, grounds, and multi-function terminals in the EL sheet.

* * * * *